US007853167B2

(12) United States Patent
Sasaki

(10) Patent No.: US 7,853,167 B2
(45) Date of Patent: Dec. 14, 2010

(54) IMAGE FORMING APPARATUS HAVING A DISPLAY WHICH INDICATES AN AMOUNT OF CONSUMABLE MATERIAL REMAINING IN A PLURALITY OF CONTAINERS

(75) Inventor: Tomohiko Sasaki, Koganai (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 11/959,049

(22) Filed: Dec. 18, 2007

(65) Prior Publication Data

US 2008/0101822 A1 May 1, 2008

(51) Int. Cl.
*G03G 15/00* (2006.01)

(52) U.S. Cl. ..... 399/81; 399/28; 399/107; 399/258

(58) Field of Classification Search ..... 399/81, 399/120, 28, 107, 258
See application file for complete search history.

(56) References Cited

U.S. PATENT DOCUMENTS

| | | | | |
|---|---|---|---|---|
| 5,909,609 | A * | 6/1999 | Yahata et al. | 399/258 |
| 6,151,471 | A | 11/2000 | Yahata et al. | |
| 6,535,702 | B1 * | 3/2003 | Takatsu | 399/81 |
| 6,648,436 | B2 | 11/2003 | Maeda | |
| 2001/0055499 | A1 * | 12/2001 | Sato | 399/111 |
| 2004/0208676 | A1 | 10/2004 | Ishii et al. | |
| 2005/0206923 | A1 * | 9/2005 | Utsumi et al. | 358/1.9 |
| 2006/0110178 | A1 | 5/2006 | Sasaki | |
| 2006/0110179 | A1 | 5/2006 | Sasaki | |
| 2007/0234912 | A1 | 10/2007 | Ishii et al. | |

FOREIGN PATENT DOCUMENTS

| | | |
|---|---|---|
| JP | H04-180072 | 6/1992 |
| JP | 2002-214868 | 7/2002 |
| JP | 2002-362807 | 12/2002 |
| JP | 2003-50351 | 2/2003 |
| JP | 2004085887 A * | 3/2004 |
| JP | 2004-188638 | 7/2004 |
| JP | 2004-317883 | 11/2004 |

OTHER PUBLICATIONS

English Machine Translation in JP 2004-085887.*
English Abstract JP 2004-085887.*
HP Color Laser Jet 5500 User's Guide, 2002.

* cited by examiner

*Primary Examiner*—David P Porta
*Assistant Examiner*—Bryan P Ready
(74) *Attorney, Agent, or Firm*—Oblon, Spivak, McClelland, Maier & Neustadt, L.L.P.

(57) ABSTRACT

An image forming apparatus includes a plurality of containers, a container compartment, and a plurality of indicators. The plurality of containers contains developing agent, and may be arranged in parallel with each other in a first sequential order. The container compartment holds the plurality of containers at varied holding heights. The plurality of indicators indicates information of the developing agent in the plurality of containers, and may be arranged in parallel to each other in a second sequential order on the image forming apparatus. The first sequential order of the plurality of containers corresponds to the second sequential order of the plurality of indicators.

26 Claims, 5 Drawing Sheets

IMAGE FORMING APPARATUS HAVING A DISPLAY WHICH INDICATES AN AMOUNT OF CONSUMABLE MATERIAL REMAINING IN A PLURALITY OF CONTAINERS

CROSS-REFERENCE TO RELATED APPLICATIONS

This application claims priority from U.S. application Ser. No. 11/281,441, filed Nov. 18, 2005 and from prior Japanese patent applications No. 2004-335295 filed on Nov. 19, 2004 in the Japan Patent Office, the entire contents of which are hereby incorporated by reference herein.

BACKGROUND OF THE INVENTION

1. Field of the Invention

The present disclosure relates to an image forming apparatus, and specifically, to an image forming apparatus that may be used as a printer, copier, facsimile, or a multi-functional apparatus integrating functions of a printer, copier, and facsimile.

2. Description of the Background

Related art image forming apparatus use an electro-photography process to produce images in color or monochrome on a recording member, such as sheet and film.

A personal computer may be connected to the image forming apparatus to be used as a printer, for example. In such usage, a user uses an image forming apparatus as his or her personal apparatus.

From the viewpoint of usability of the image forming apparatus (e.g. printer), the image forming apparatus is generally placed in an area which is close to a personal computer of the user.

In such an environment, a relatively small apparatus is preferable when considering operability of image forming apparatus. The apparatus may have smaller dimensions (e.g., height, width, length) to accommodate the image forming apparatus in a smaller area.

Furthermore, from the viewpoint of enhancing usability and reducing maintenance costs for a personal user, the image forming apparatus may have a configuration which is user-friendly when a user conducts replacement work of consumable supplies, such as a developing agent (i.e., toner) and/or maintenance work by him or herself.

Generally, an image forming apparatus includes four color developing agents (i.e., toners) to conduct color image forming, for example.

Therefore, such a color image forming apparatus may have a relatively large number of components compared to a monochrome image forming apparatus. Thereby such a color image forming apparatus may be more likely to occupy a larger space than a monochrome image forming apparatus.

Furthermore, productivity of such a color image forming apparatus may become lower because color image printing may require more time than monochrome printing, wherein productivity may be expressed by indicators, such as a number of pages to be printed per unit time.

Therefore, an image forming apparatus using tandem type may be used to conduct color image printing, in which the image forming apparatus includes a plurality of photosensitive members, arranged in one direction, and a plurality of developing units, disposed closely to each of the photosensitive members. With such a configuration, each color image formed on the each of the photosensitive members can be sequentially transferred to a recording member.

In general, such tandem type image forming apparatus may consume a relatively large amount of toner. Thereby, from the viewpoint of operability of the image forming apparatus, a refilling unit may be provided separately from a developing unit rather than integrating the refilling unit and the developing unit as a cartridge. The refilling unit supplies refilling toners to the developing unit.

Furthermore, in order to reduce an area or space occupied by the image forming apparatus, the image forming apparatus may have a sheet ejection portion, which stacks printed recording members, on its top side, for example.

The image forming apparatus of tandem type may have the properties as above-mentioned, and a further enhancement of operability of the image forming apparatus of tandem type may be made.

An image forming apparatus for color image forming requires a plurality of developing agent containers (e.g., toner bottles), thereby a consideration may be given to "visibility" to enhance operability of the developing agent containers.

For example, in an image forming apparatus, a plurality of toner bottles may be arranged in one direction, which is perpendicular to an ejection direction of recording members, for example.

However, such an image forming apparatus may have a configuration that a user may feel it is difficult to operate the image forming apparatus.

Generally, a user is not familiar to configurations and replacement work of image forming apparatus. Thereby the user may feel difficulties to conduct replacement work for the image forming apparatus.

SUMMARY OF THE INVENTION

An exemplary embodiment of the invention relates to an image forming apparatus including a plurality of containers, a container compartment, and a plurality of indicators. The plurality of containers contain developing agent, and may be arranged in parallel to each other with a first sequential order. The container compartment holds the plurality of containers at varied holding heights. The plurality of indicators indicates information of the developing agent in the plurality of containers, and may be arranged in parallel to each other with a second sequential order on the image forming apparatus. The first sequential order of the plurality of containers corresponds to the second sequential order of the plurality of indicators.

Another exemplary embodiment of the invention relates to a method of placing a plurality of containers containing developing agent and a plurality of indicators indicating an amount information of the developing agent in the plurality of containers for use in an image forming apparatus. The method may include arranging the plurality of containers in parallel to each other with a first sequential order in the image forming apparatus; holding the plurality of containers at varied holding heights; and providing the plurality of indicators on the image forming apparatus in parallel to each other in a second sequential order corresponding to the first sequential order of the plurality of containers.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXEMPLARY EMBODIMENTS OF THE INVENTION

Figure 1:
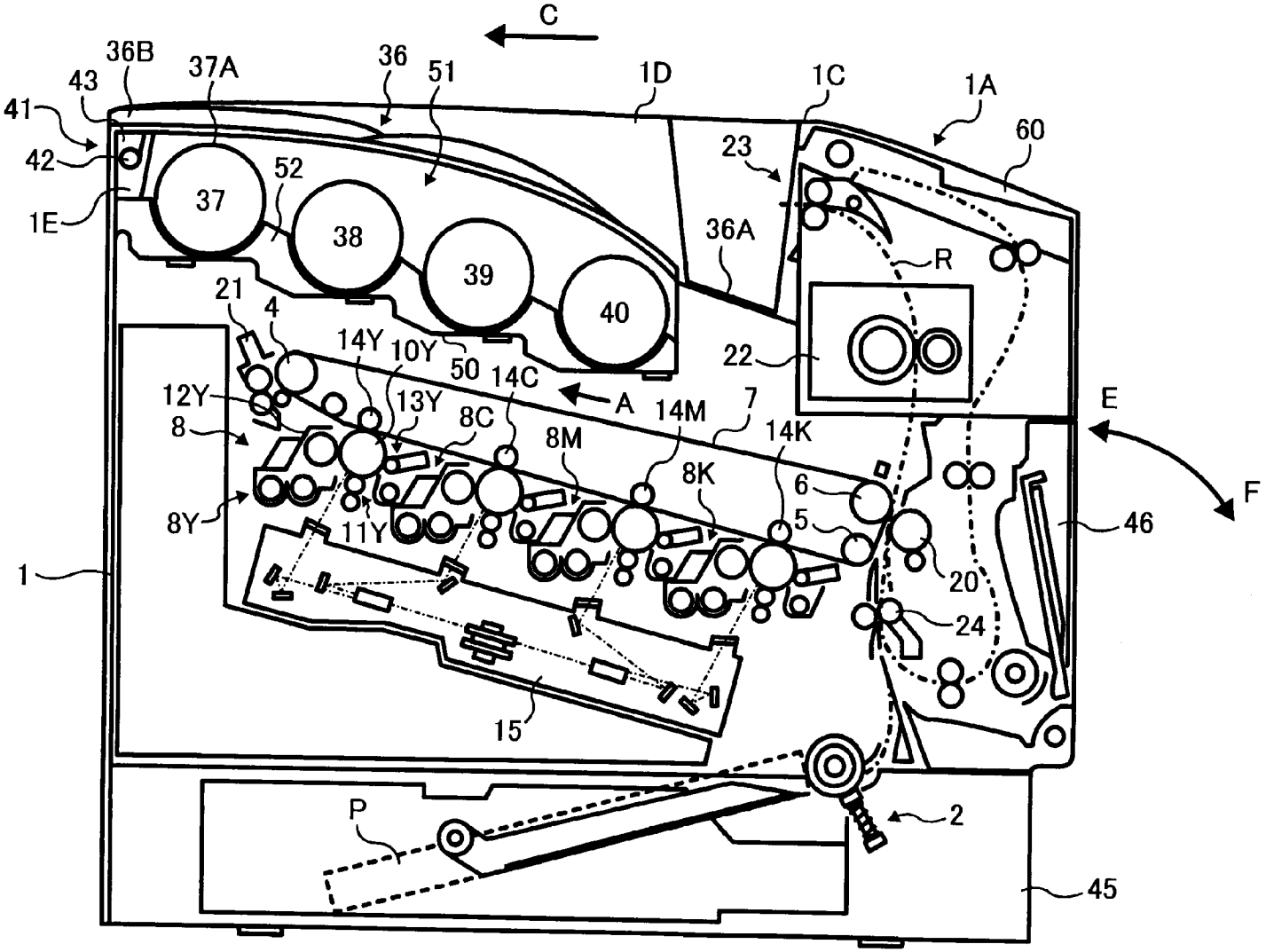
FIG. 1 is a schematic cross-sectional view of an image forming apparatus according to an exemplary embodiment.

In describing exemplary embodiments shown in the drawings, specific terminology is employed for the sake of clarity. However, the disclosure is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus of tandem type are described with reference to FIGS. 1 to 3.

The image forming apparatus of tandem type includes a color printer, copier, facsimile, multi-functional apparatus, for example.

FIG. 1 is a schematic cross-sectional view of an image forming apparatus 1 according to an exemplary embodiment.

The image forming apparatus 1 includes a sheet feed unit 2, an image forming section 8, a fixing unit 22, and a container compartment 51.

The sheet feed unit 2 includes a sheet feed cassette 45 to store sheet P as a recording member.

The image forming section 8 is disposed over the sheet feed unit 2. The image forming section 8 includes image forming units 8Y, 8C, 8M, and 8K, rollers 4, 5, and 6, an intermediate transfer belt 7, and an optical writing unit 15.

Each of the image forming units 8Y, 8C, 8M, and 8K includes a photosensitive member 10 as an image carrying member.

The intermediate transfer belt 7 is a flexible endless belt extended by the rollers 4, 5, and 6.

The optical writing unit 15 writes images on each of the photosensitive members 10 with a light beam.

The fixing unit 22 fixes toner images on the sheet P.

From the sheet feed unit 2 to the fixing unit 22, a transport route R is provided to transport the sheet P.

The roller 6 is provided at a position which faces the transport route R via the intermediate transfer belt 7 as shown in FIG. 1.

The roller 6 faces a secondary transfer roller 20 via the intermediate transfer belt 7 as shown in FIG. 1, wherein the secondary transfer roller 20 is disposed as a secondary transfer unit along the transport route R.

The roller 4 faces a belt cleaning unit 21 by sandwiching the intermediate transfer belt 7 between the roller 4 and the belt cleaning unit 21, wherein the belt cleaning unit 21 is disposed to clean a surface of the intermediate transfer belt 7.

As shown in FIG. 1, the image forming section 8 is provided under the intermediate transfer belt 7.

Each of the image forming units 8Y, 8C, 8M, and 8K includes a photosensitive member 10 as image carrying member, wherein the photosensitive member 10 can contact the intermediate transfer belt 7. The photosensitive member 10 may have a roller shape, for example.

The photosensitive member 10 is surrounded by a plurality of units, such as a charge unit 11, a developing unit 12, and a cleaning unit 13, for example.

As shown in FIG. 1, a primary transfer roller 14 is disposed on an inner surface of the intermediate transfer belt 7 as a primary transfer roller. The primary transfer roller 14 faces the photosensitive member 10 by sandwiching the intermediate transfer belt 7 between the primary transfer roller 14 and the photosensitive member 10.

Each of the image forming units 8Y, 8C, 8M, and 8K has a configuration similar to one another. Therefore reference signs are attached to units around the image forming unit 8Y in FIG. 1.

However, each of the image forming unit 8Y, 8C, 8M, and 8K includes respective color tones as a developing agent in the developing unit 12. The developing unit 12 of each of the image forming units 8Y, 8C, 8M, and 8K contains yellow toner, cyan toner, magenta toner, and black toner, respectively.

As shown in FIG. 1, the optical writing unit 15 is provided under the image forming section 8.

The optical writing unit 15 irradiates a laser beam L, modulated based on image data, to the surface of the photosensitive member 10 to form an electrostatic latent image of each color on the surface of the photosensitive member 10.

The photosensitive member 10 of the image forming units 8Y, 8C, 8M, and 8K is coupled to a driving unit (not shown).

When an image forming process is activated, the driving unit (not shown) rotates the photosensitive member 10 of the image forming units 8Y, 8C, 8M, and 8K in a clockwise direction, and the charge unit 11 uniformly charges the surface of photosensitive member 10.

Then, the optical writing unit 15 irradiates the laser beam L on the charged surface of the photosensitive member 10 to form an electrostatic latent image on the surface of the photosensitive member 10.

The laser beam L irradiated to the surface of the photosensitive member 10 corresponds to each color image data of yellow, cyan, magenta, and black, which constitute a full color image to be produced.

Such electrostatic latent image is developed as toner image (i.e., visible image) when the developing unit 12 applies toners to the electrostatic latent image on the photosensitive member 10.

As above-mentioned, the intermediate transfer belt 7 is extended by the rollers 4, 5, and 6.

A driving unit (not shown) rotates any one of the rollers 4, 5, and 6 in a counter-clockwise direction, for example.

With such rotation of the roller, the intermediate transfer belt 7 travels in a direction shown by an arrow A in FIG. 1, and such traveling of the transfer belt 7 rotates two other rollers not driven by the driving unit (not shown).

During such traveling of the intermediate transfer belt 7, a yellow toner image formed by the image forming unit 8Y is transferred to the intermediate transfer belt 7 via the primary transfer roller 14.

Then, cyan toner image, magenta toner image, and black toner image formed by image forming unit 8C, 8M, and 8K are sequentially transferred and superimposed on the yellow toner image via the respective primary transfer roller 14 to form a full color toner image on the surface of the intermediate transfer belt 7.

After transferring toner images to the intermediate transfer belt 7, toners remaining on the surface of the photosensitive member 10 are removed by the cleaning unit 13. Then the surface of the photosensitive member 10 is de-charged by a de-charge unit (not shown) for a next image forming process.

The sheet P, fed into the transport route R from the sheet feed unit 2, is then fed to a pair of registration rollers 24, wherein the pair of registration rollers 24 is disposed in an upstream direction of the transport route R with respect to the secondary transfer roller 20.

The pair of registration rollers 24 feed the sheet P to a nip portion formed between the roller 6 and the secondary transfer roller 20 while considering a feed timing.

The secondary transfer roller 20 biases a transfer voltage having a polarity which is opposite to the polarity of the toner image on the surface of the intermediate transfer belt 7.

With an effect of such transfer voltage, the toner image on the surface of the intermediate transfer belt 7 is transferred to the sheet P.

Then, the sheet P having the toner image thereon is transported to the fixing unit 22. The fixing unit 22 applies heat and pressure to the sheet P to fix the toner image on the sheet P.

Then the sheet P having the fixed toner image thereon is transported to an ejection port 23, which is disposed at an end of the transport route R and an upper side of the image forming apparatus 1.

The sheet P is then ejected to a stacking portion 36 provided on a top side of the image forming apparatus 1 through the ejection port 23.

After transferring the toner image to the sheet P, toners remaining on the intermediate transfer belt 7 is removed by a belt cleaning unit 21.

The above-described image forming apparatus 1 (e.g., printer) includes the four image forming units 8Y, 8M, 8C, and 8K, which are arranged in tandem manner and facing the intermediate transfer belt 7 so that each color toner image is superimposed and transferred to the intermediate transfer belt 7 sequentially.

The above-described image forming apparatus 1 can reduce an image forming process time compared to an image forming apparatus including one image forming unit and four developing units for yellow, cyan, magenta, and black, color, in which each color toner image is transferred on the intermediate transfer belt one by one, and then transferred to the sheet.

Furthermore, as above-mentioned, the stacking portion 36 is provided on the top side of the image forming apparatus 1. Thereby the stacking portion 36 is within a projected area of the image forming apparatus 1 in a vertical direction of the image forming apparatus 1.

Therefore, the image forming apparatus 1 may occupy a relatively smaller area or space.

In the above-described example, the image forming apparatus 1 conducts an image forming process for a full color image on the sheet P.

However, the image forming apparatus 1 can also conduct single color image forming by using any one of the image forming units 8Y, 8M, 8C, and 8K, and two or three color image forming by using any two or three image forming units 8Y, 8M, 8C, and 8K.

When conducting a monochrome printing by the image forming apparatus 1, the image forming unit 8K is used to form and develop an electrostatic latent image on the photosensitive member 10, and the developed image is transferred to the sheet P and fixed on the sheet P by the fixing unit 22.

As shown in FIG. 1, an ejection port 23 is provided in rightward of an upper side of the image forming apparatus 1.

Figure 2:
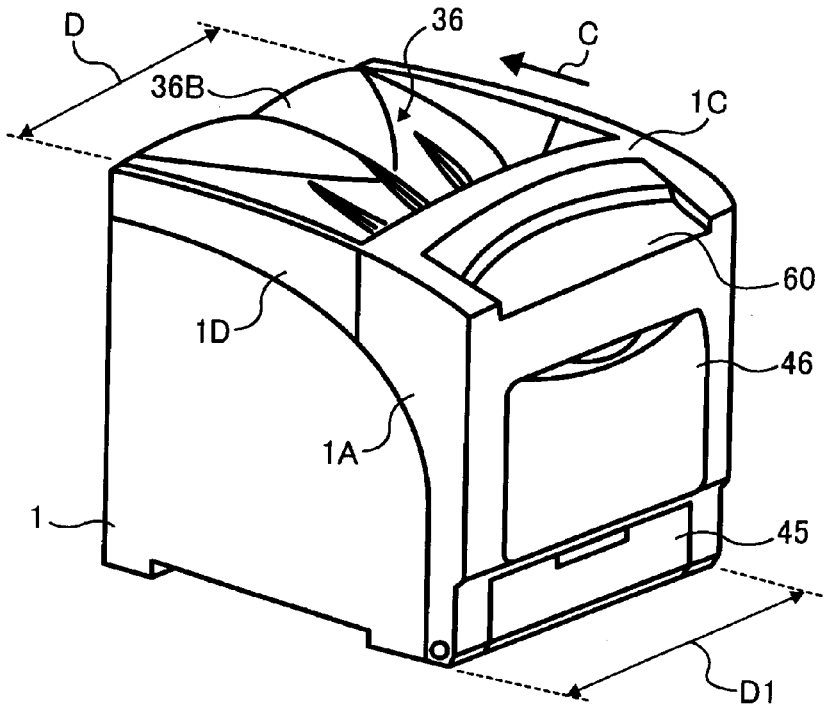
FIG. 2 is a schematic perspective view of an image forming apparatus of FIG. 1.

As shown in FIGS. 1 and 2, the image forming apparatus 1 includes an outer cover 1A, which is provided in a right side of the image forming apparatus 1, and covers the ejection port 23 when the outer cover 1A is closed.

The outer cover 1A includes an operation panel 60 and a tray 46, as shown in FIGS. 1 and 2.

The operation panel 60 is used to operate the image forming apparatus 1, such as a printer, and the tray 46 is used to place the sheet P when the tray 46 is opened. As shown in FIG. 1, the tray 46 can be opened in a direction shown by an arrow F and can be closed in a direction shown by an arrow E.

As shown in FIGS. 1 and 2, the operation panel 60 and the tray 46 can be accessible from a right side of the image forming apparatus 1, wherein the right side of the image forming apparatus 1 in FIGS. 1 and 2 corresponds to a front side of the image forming apparatus 1 when the image forming apparatus 1 is placed in actual environment, such as a company office.

As shown in FIGS. 1 and 2, the operation panel 60 and the tray 46 may be provided on the right side of the image forming apparatus 1, for example As shown in FIG. 1, the image forming apparatus 1 includes a partition plate 50 under the stacking portion 36.

The partition plate 50 is disposed in a space between the stacking portion 36 and the intermediate transfer belt 7 to provide a container compartment 51 in the image forming apparatus 1, as shown in FIG. 1. The container compartment 51 can accommodate a container, such as toner bottle.

As shown in FIG. 1, the container compartment 51 accommodates a plurality of toner bottles 37, 38, 39, and 40 as developing agent containers for four colors.

For example, the toner bottles 37, 38, 39, and 40 can be installed in the container compartment 51 by arranging the toner bottles 37, 38, 39, and 40 in a tandem manner along a direction shown by an arrow C in FIG. 1.

In other words, the longitudinal direction (i.e., axial direction) of each of the toner bottles 37, 38, 39, and 40 is substantially perpendicular to a sheet ejection direction, which comes from the ejection port 23.

The arrow C shows a direction wherein a distance from the ejection port 23 increases in the direction of the arrow. Such direction is referred to as ejection direction C.

The toner bottles 37, 38, 39, and 40 may contain yellow toner, cyan toner, magenta toner, and black toner, respectively.

Each of the toner bottles 37, 38, 39, and 40 is connected to the developing unit 12 of the image forming units 8Y, 8C, 8M, and 8K, respectively, via toner supply lines (not shown).

When the toner in the developing unit 12 is decreased, refilling toners are supplied to the developing unit 12 via the toner supply line (not shown).

Furthermore, the toner bottles 37, 38, 39, and 40 are arranged in an inclined manner, in which the toner bottle 37 is placed in a lowest position with respect to other toner bottles 38, 39, and 40, and the toner bottle 40 is placed in a highest position with respect to other toner bottles 37, 38, and 39.

As shown in FIG. 1, the height of the each toner bottles of 37, 38, 39, and 40 are gradually increased in a direction from the toner bottle 37 to the toner bottle 40 when the toner bottles of 37, 38, 39, and 40 are placed in the container compartment 51.

The height of the ejection port 23 may be higher than that of the toner bottle 37, and substantially at a same level of the toner bottle 40.

As shown in FIG. 1, the container compartment 51 includes a holder 52 to detachably support the toner bottles 37, 38, 39, and 40.

The image forming apparatus 1 has a configuration that the toner bottles 37, 38, 39, and 40 can be detached from the holder 52 in an upward direction of the image forming apparatus 1.

With such a configuration, each of the toner bottles 37, 38, 39, and 40 is detachable from the holder 52 into a space over the image forming apparatus 1.

When considering a horizontal area of such space, such a horizontal area may be substantially within a projected area of the image forming apparatus 1 in a vertical direction.

In other words, the toner bottles 37, 38, 39, and 40 are detachable from the image forming apparatus 1 in a space over the image forming apparatus 1 having a width D1.

An arrangement order of the toner bottles 37, 38, 39, and 40 can be determined by setting an installation position of the toner bottles 37, 38, 39, and 40 in the holder 52 of the image forming apparatus 1.

For example, as above-mentioned, the toner bottles 37, 38, 39, and 40 can contain yellow toner, cyan toner, magenta toner, and black toner, respectively, and the toner bottles 37, 38, 39, and 40 can be arranged in the holder 52 with a sequential order along the ejection direction C. In other words, yellow toner, cyan toner, magenta toner, and black toner can be arranged in the holder 52 with a sequential order along the ejection direction C.

The toner bottles 37, 38, 39, and 40 may contain any color toners. Thereby a sequential order of the color toners (yellow, cyan, magenta, black) along the ejection direction C can be changed, as required.

As shown in FIG. 1, the stacking portion 36 extends from one side of the image forming apparatus 1, close to the ejection port 23, to other side of the image forming apparatus 1.

In other words, the stacking portion 36 extends on a top portion of the image forming apparatus 1 in the ejection direction C.

As shown in FIGS. 1 and 2, the stacking portion 36 is formed on an outer cover 1D of the image forming apparatus 1, which is used to cover the toner bottles 37, 38, 39, and 40 installed in the container compartment 51.

Figure 3:
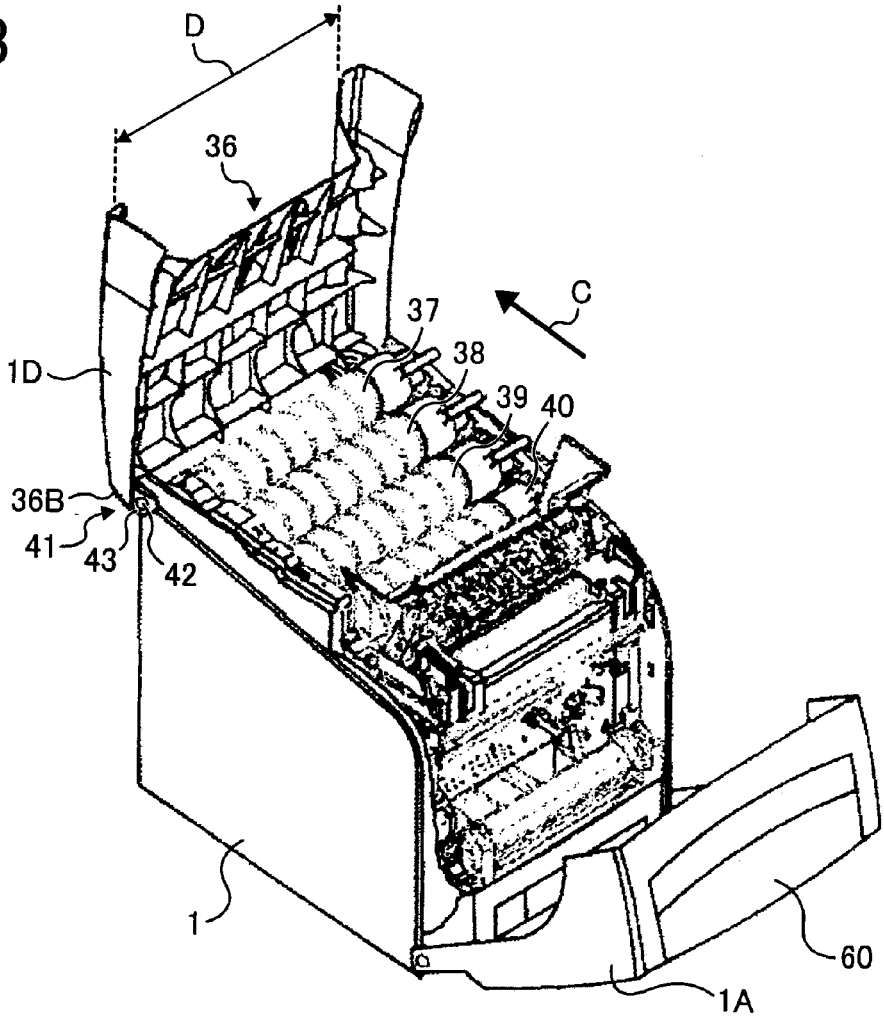
FIG. 3 is schematic perspective view of an image forming apparatus of FIG. 1, in which a cover is opened.

The outer cover 1D including the stacking portion 36 is pivotable with respect to the image forming apparatus 1, and can be opened in an upward direction as shown in FIG. 3.

As shown in FIGS. 1 and 3, the outer cover 1D is pivotably supported to the image forming apparatus 1 by a pivot unit 41, which is provided at an upper end side 1E of the image forming apparatus 1. In FIG. 1, the upper end side 1E is a side, which is opposite to a side where the operation panel 60 is provided.

As shown in FIGS. 1 and 3, the height of the pivot unit 41 is lower than a top position 37A of the toner bottle 37, for example.

The pivot unit 41 includes a shaft 42 and a shaft holder 43 as shown in FIGS. 1 and 3.

As shown in FIG. 3, the shaft 42 extends in a direction shown by arrows D, wherein the direction of arrows D is parallel to the width D1 of the image forming apparatus 1 and perpendicular to the ejection direction C.

The shaft holder 43, formed in an end portion 36B of the stacking portion 36, supports the shaft 42.

With such a configuration, the outer cover 1D including the stacking portion 36 can be opened in an upward direction of the image forming apparatus 1.

When the outer cover 1D is opened in an upward direction, the outer cover 1D comes to a position which is remote from the side of the image forming apparatus 1 provided with the operating panel 60.

Accordingly, the outer cover 1D comes to a position which is remote from the ejection port 23.

The stacking portion 36 may have an area, which is larger than a sheet stored in the sheet feed unit 2.

Furthermore, the stacking portion 36 includes an end portion 36A, which comes to a position close to the ejection port 23 when the outer cover 1D is closed to the image forming apparatus 1.

The stacking portion 36 has an inclined face as shown in FIGS. 1 and 2. Thereby the height of the end portion 36A is lower than that of the end portion 36B.

Furthermore, the end portion 36A of the stacking portion 36 comes to a position, which is lower than the ejection port 23, at which the sheet P is ejected.

The end portion 36B of the stacking portion 36 comes to a position, which is substantially at a similar height of a top portion 1C of the outer cover 1A.

As described above, the toner bottles 37, 38, 39, and 40 are detachable from the image forming apparatus 1. The toner bottles 37, 38, 39, and 40 can be handled for replacement work in a space over the image forming apparatus 1 having the width D1.

With such configuration, an operability of the image forming apparatus 1, such as replacement work for replacement parts, can be enhanced.

Furthermore, the toner bottles 37, 38, 39, and 40 are arranged in an inclined manner, in which the toner bottle 37 is at the lowest level and the toner bottle 40 is at the highest level. Thereby a user can see the toner bottles 37, 38, 39, and 40 one by one when the user sees the toner bottles 37, 38, 39, and 40 from a side having the operation panel 60 (or ejection port 23 side).

Figure 4:
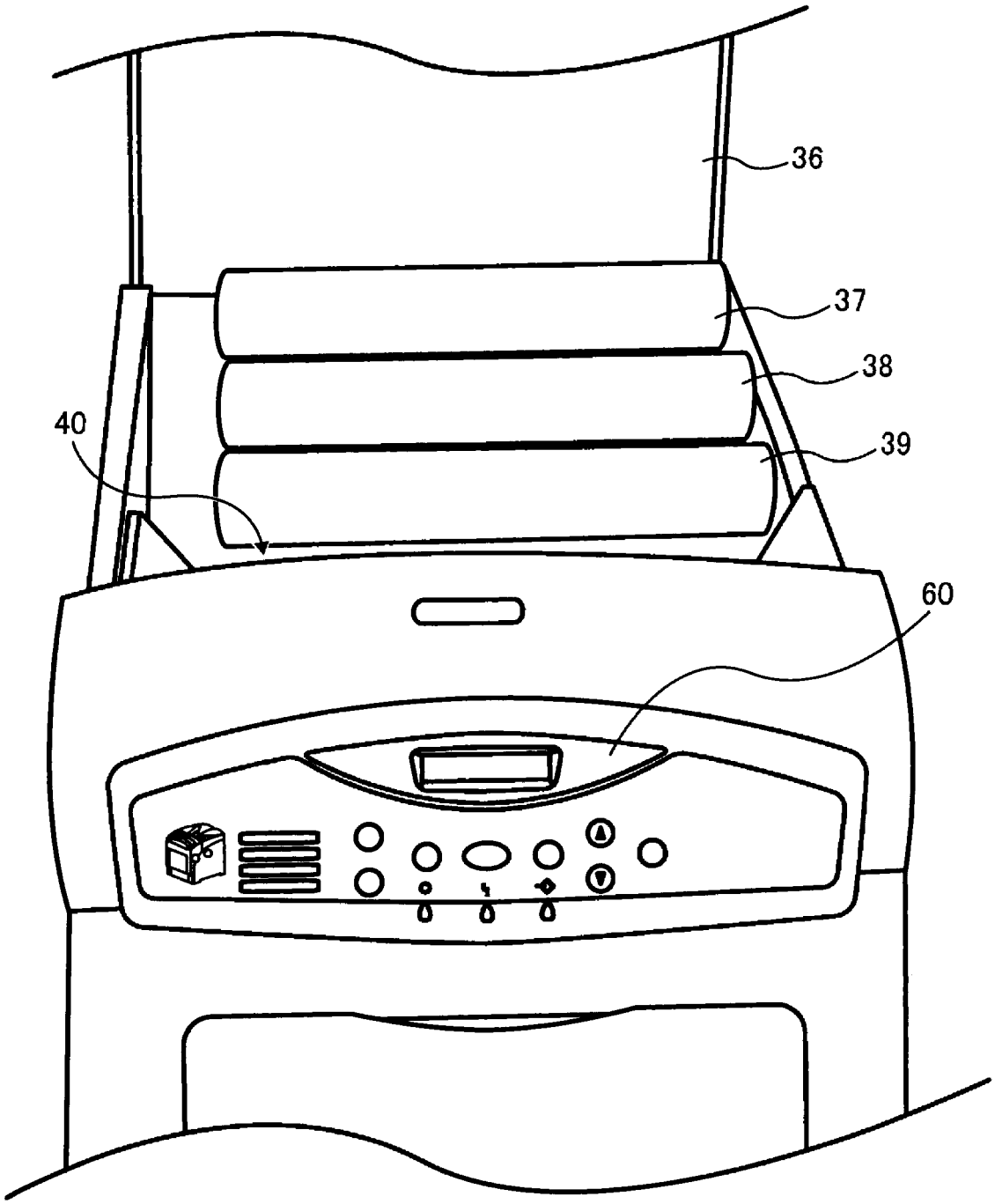
FIG. 4 is a schematic front view of an operation panel of an image forming apparatus of FIG. 1, in which a cover is opened.

As shown in FIGS. 3 and 4, the user can see each of the toner bottles 37, 38, 39, and 40 because each of the toner bottles 37, 38, 39, and 40 is installed in the container compartment by a differentiating installation height of the toner bottles 37, 38, 39, and 40.

With such a configuration, the toner bottles 37, 38, 39, and 40 are not hidden behind the ejection port 23, and the visibility of the each toner bottle from the operation panel 60 side can be enhanced.

Therefore, an operability of the image forming apparatus 1, such as replacement work for replacement parts, can be enhanced.

Furthermore, the stacking portion 36 can be pivotably supported to the image forming apparatus 1 by using the pivot unit 41, provided at the end portion 1E of the image forming apparatus 1, which is remote from the ejection port 23, as shown in FIGS. 1 and 3.

With such a configuration, the visibility of toner bottles installed in positions close to the pivot unit 41 may be enhanced because the stacking portion 36 do not hide the toner bottles when the stacking portion 36 is opened.

Furthermore, the stacking portion 36 can be opened and closed along the ejection direction C.

With such a configuration, an opening operability of the stacking portion 36 can be enhanced, and the visibility of the each toner bottle from the operation panel 60 side can be enhanced.

Therefore, an operability of the image forming apparatus 1, such as replacement work for replacement parts, can be enhanced.

The pivot unit 41 may be provided at a position which is lower than the top portion 37A of the toner bottle 37 so that the height of the stacking portion 36 can be lowered. By lowering the height of the stacking portion 36, a height-increase of the image forming apparatus 1 can be suppressed.

With such a configuration, the visibility of the each toner bottle from the operation panel 60 side can be enhanced.

Therefore, an operability of the image forming apparatus 1, such as replacement work for replacement parts, can be enhanced.

Furthermore, the stacking portion 36 can be opened in an upward direction of the image forming apparatus 1, and the opened stacking portion 36 comes to a position which is remote from the outer cover 1A including the operation panel 60.

With such a configuration, the visibility of the each toner bottle from the operation panel 60 side can be enhanced.

Therefore, an operability of the image forming apparatus 1, such as replacement work for replacement parts, can be enhanced.

FIG. 4 is a perspective front view of the image forming apparatus 1 when the outer cover 1D is opened.

As shown in FIG. 4, when the outer cover 1D including the stacking portion 36 is opened, and the toner bottles 38, 39, 37 can be seen from the operation panel 60 side.

Although toner bottle 40 is not visible in FIG. 4, the toner bottle 40 can be seen from the operation panel 60 side by just changing a observer's point of view.

As described above, the longitudinal direction (i.e., axial direction) of the toner bottles 37, 38, 39, and 40 is perpendicular to the ejection direction C of the sheet P, and the toner bottles 37, 38, 39, and 40 are arranged in a tandem manner in the ejection direction C.

Figure 5A:
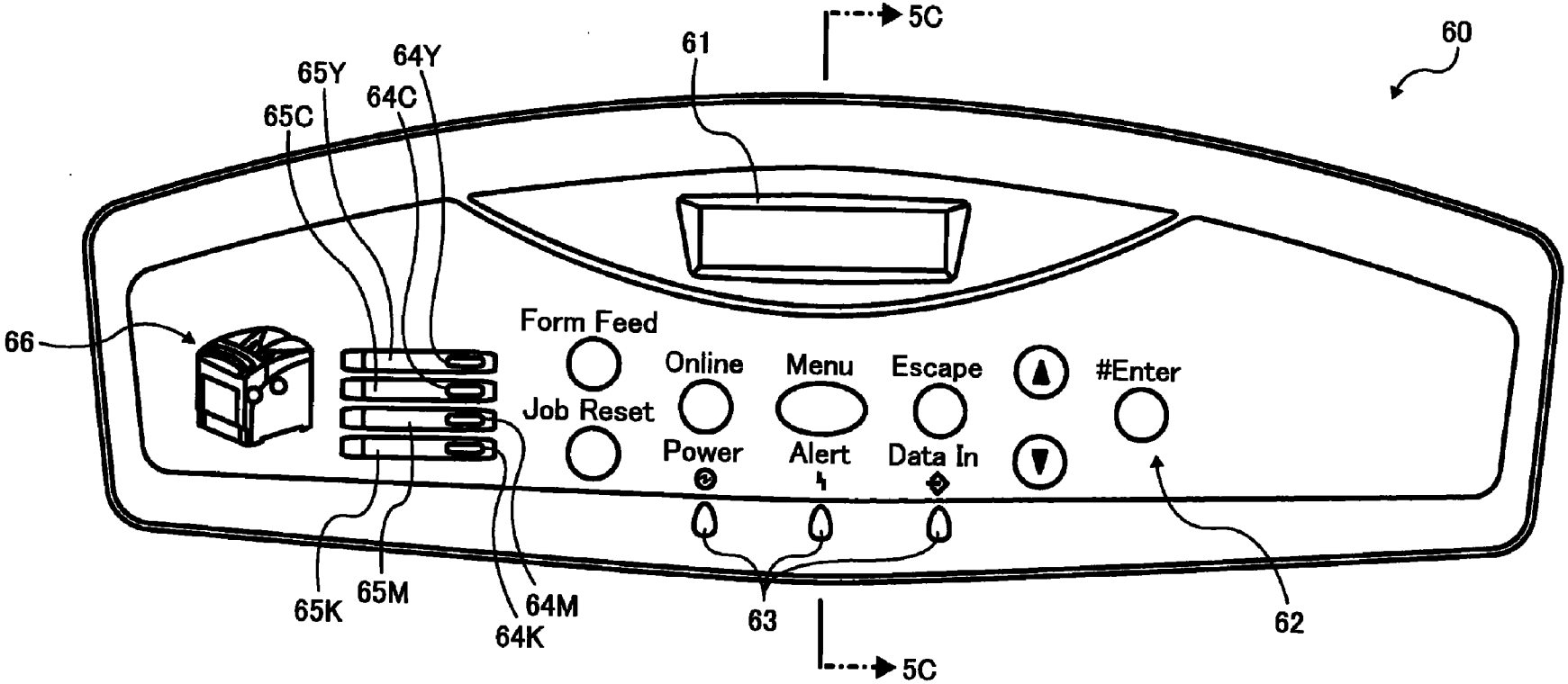
FIG. 5A is a schematic view of an operation panel of an image forming apparatus.

As shown in FIG. 5A, the operation panel 60 includes a liquid crystal panel 61, operation buttons 62, LED (light emitting diode) lens 63, LEDs 64Y, 64C, 64M, and 64K, indicator marks 65Y, 65C, 65M, and 65K, and a symbol mark 66.

The liquid crystal panel 61 displays operation status. The LED lens 63 indicates power-on status, for example.

The LEDs 64Y, 64C, 64M, and 64K indicate a toner end status or a toner near-end status of the toner bottles 37, 38, 39, and 40, respectively. The toner end status means that toner is empty in the toner bottle. The toner near-end status means that toner is almost empty in the toner bottle.

The LEDs 64Y, 64C, 64M, and 64K may include at least one light emitting diode to indicate toner end status or a toner near-end status by lighting the light emitting diode. For example, the LEDs 64Y, 64C, 64M, and 64K may change its lighting color for indicating each of the toner end status and the toner near-end status. Such light color includes any colors.

The indicator marks 65Y, 65C, 65M, and 65K are provided with the LEDs 64Y, 64C, 64M, and 64K, respectively, wherein the indicator marks 65Y, 65C, 65M indicate the toner color.

The symbol marks 66 indicate operation points of the image forming apparatus 1.

The liquid crystal panel 61 and the operation buttons 62 can be composed of related art parts having general functionality. Each of the indicator marks 65Y, 65C, 65M, and 65K may have a rectangular-like shape.

The rectangular-like shape may include any shape, which resembles a shape of the toner bottle, such as rectangular shape, substantially rectangular shape having rounded corners, and a slender shape, for example.

As shown in FIGS. 4 and 5A, a longitudinal direction of the indicator marks 65Y, 65C, 65M, and 65K having the rectangular-like shape is parallel to the longitudinal direction of the toner bottles 37, 38, 39, and 40.

In other words, the longitudinal direction of the indicator marks 65Y, 65C, 65M, and 65K is perpendicular to the ejection direction C as in the toner bottles 37, 38, 39, and 40.

As shown in FIG. 4, a user may have good visibility of the operation panel 60 and the toner bottles 37, 38, 39, and 40 at the same time from a front side of the image forming apparatus 1, wherein the user usually approaches the image forming apparatus 1 from the front side of the image forming apparatus 1.

Furthermore, color toner information of the toner bottles 37, 38, 39, and 40 are indicated by the indicator marks 65Y, 65C, 65M, and 65K provided with the LEDs 64Y, 64C, 64M, and 64K, respectively.

An arrangement order of the indicator marks 65Y, 65C, 65M, and 65K on the operation panel 60 corresponds to the arrangement order of the toner bottles 37, 38, 39, and 40.

With such a configuration, when one of the LEDs 64Y, 64C, 64M, and 64K lights to indicate the toner end status or the toner near-end status, a user can identify which toner bottles is in the toner end status or the toner near-end status at one glance because the arrangement order of the indicator marks 65Y, 65C, 65M, and 65K and the arrangement order of toner bottles 37, 38, 39, and 40 corresponded each other.

Therefore, when the outer cover 1D is opened for replacement work, a user can see easily identify a to-be-replaced toner bottle by checking an indicator mark having a lit LED. With such a configuration, a user can conduct a replacement work without confusing other toner bottle.

Figure 5C:
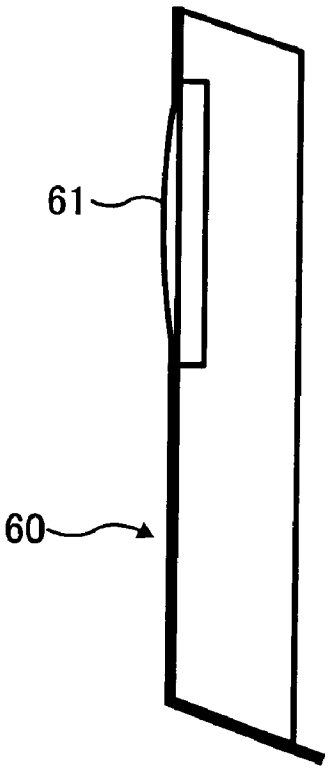
FIG. 5C is a schematic cross-sectional view of an operation panel of FIG. 5A, taken along line 5C-5C in FIG. 5A.
Figure 5B:
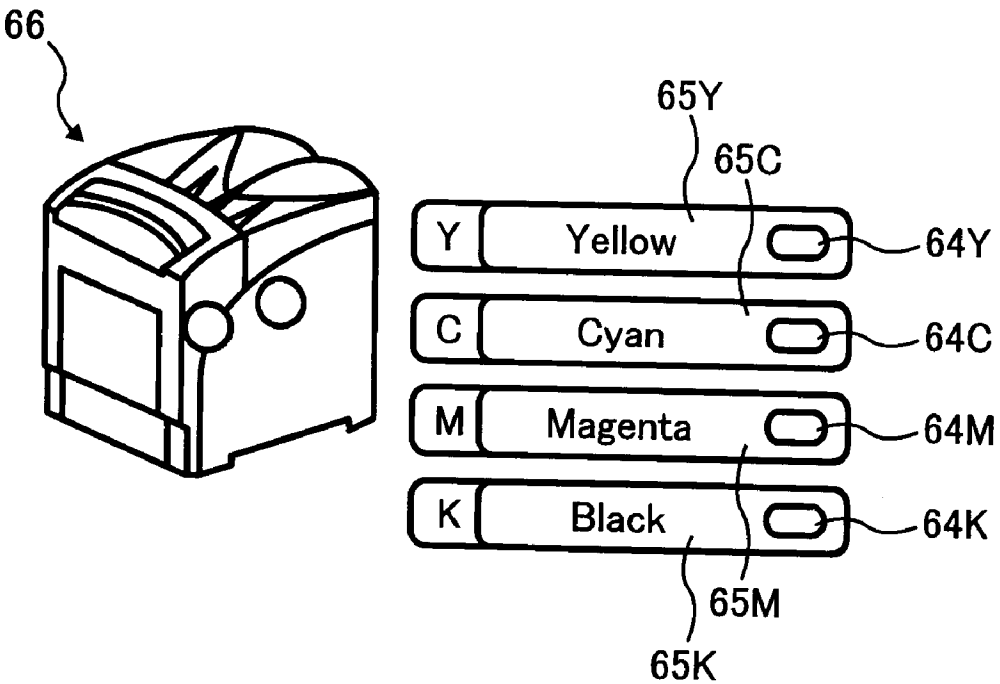
FIG. 5B is a schematic view of indicators on an operation panel of FIG. 5A.

FIG. 5A is a schematic view of the operation panel 60. FIG. 5B is a schematic view of indicator marks 65Y, 65C, 65M, and 65K on the operation panel 60. FIG. 5C is a schematic cross-sectional view of an operation panel 60, which is taken along line 5C-5C in FIG. 5A.

Numerous additional modifications and variations are possible in light of the above teachings. It is therefore to be understood that the disclosure is non-limiting.

The invention claimed is:

1. An image forming system, comprising:

a plurality of containers, arranged in a sequential order within the image forming system, the containers including at least four different colors of consumable material used to print an image on a medium;

a cover which covers the plurality of containers;

a printing engine configured to print the image on the medium using the consumable material; and an operation panel, mounted to the image forming system, including a display, the display configured to display information of the consumable material within the containers such that there is a display portion corresponding to each of the containers and an arrangement of the display portions corresponds to said sequential order of the plurality of containers, when viewed from a side of the operation panel, the display portions each having an indication of color of the consumable material in a corresponding one of the plurality of containers such that a sequence of colors of the consumable material of the plurality of containers is the same as a sequence of the display portions corresponding to the containers, wherein the indications of color indicate at least four different colors of consumable material, and the display portions corresponding to each of the containers are adjacent to no more than two others of the plurality of indicators, wherein when the consumable material in one of the plurality of containers becomes a near empty state, the corresponding display portion indicates a near empty state for the color of that consumable material, wherein the image forming system is structured such that when the cover is at an open position, the containers within the image forming system and the display portions corresponding to each of the containers are simultaneously viewable, and wherein when the consumable material in one of the plurality of containers becomes an empty state, the corresponding display portion indicates that there is no substance of a particular color for use in the image forming system.

2. An image forming system according to claim 1, wherein:

the display portion corresponding to each of the containers includes an LED corresponding to each of the containers.

3. An image forming system according to claim 1, wherein:

the printing engine includes a laser beam generator and a photosensitive member.

4. An image forming system according to claim 1, wherein:

the printing engine is configured to use toner as the consumable material.

5. An image forming system according to claim 1, wherein:

the colors of the consumable material in the plurality of containers are respectively cyan, magenta, and yellow.

6. An image forming system according to claim 1, wherein:

the plurality of containers are at varied holding heights.

7. An image forming system according to claim 1, wherein:

the each of the plurality of containers has a cylindrical shape, and each of the display portions has a rectangular shape.

8. An image forming system according to claim 1, wherein:

the plurality of containers are arranged in parallel with each other and the display portions are arranged in parallel with each other.

9. An image forming system according to claim 1, wherein:

the indications of color which indicate at least four different colors of consumable material indicate colors of the consumable material which are black, yellow, cyan, and magenta.

10. An image forming system according to claim 1, wherein:

the indications of color which indicate at least four different colors of consumable material are the same colors as the colors of the consumable materials.

11. An image forming system according to claim 1, wherein:

the display portion corresponding to each of the containers includes a display portion that is configured to emit a colored light.

12. An image forming system, comprising:

a plurality of containers, arranged in a sequential order within the image forming system, the containers including at least four different colors of consumable material used to print an image on a medium;

a cover which covers the plurality of containers;

a printing engine configured to print the image on the medium using the consumable material; and an operation panel, mounted to the image forming system, including a means for displaying, the means for displaying operating to display information of the consumable material within the containers such that there is a display portion corresponding to each of the containers and an arrangement of the display portions corresponds to said sequential order of the plurality of containers, when viewed from a side of the operation panel, the display portions each having an indication of color of the consumable material in a corresponding one of the plurality of containers such that a sequence of colors of the consumable materials of the plurality of containers is the same as a sequence of the display portions corresponding to the containers, wherein the indications of color indicate at least four different colors of consumable material, and the display portions corresponding to each of the containers are adjacent to no more than two others of the plurality of indicators, wherein when the consumable material in one of the plurality of containers becomes a near empty state, the corresponding display portion indicates a near empty state for the color of that consumable material, wherein the image forming system is structured such that when the cover is at an open position, the containers within the image forming system and the display portions corresponding to each of the containers are simultaneously viewable, and wherein when the consumable material in one of the plurality of containers becomes an empty state, the corresponding display portion indicates that there is no substance of a particular color for use in the image forming system.

13. An image forming system according to claim 12, wherein:

the display portion corresponding to each of the containers includes an LED corresponding to each of the containers.

14. An image forming system according to claim 12, wherein:

the printing engine includes a laser beam generator and a photosensitive member.

15. An image forming system according to claim 12, wherein:

the printing engine is configured to use toner as the consumable material.

16. An image forming system according to claim 12, wherein:

the colors of the consumable material in the plurality of containers are respectively cyan, magenta, and yellow.

17. An image forming system according to claim 12, wherein:

the plurality of containers are at varied holding heights.

18. An image forming system according to claim 12, wherein:

the each of the plurality of containers has a cylindrical shape, and each of the display portions has a rectangular shape.

19. An image forming system according to claim 12, wherein:

the plurality of containers are arranged in parallel with each other and the display portions are arranged in parallel with each other.

20. An image forming system according to claim 12, wherein:

the indications of color which indicate at least four different colors of consumable material indicate colors of the consumable material which are black, yellow, cyan, and magenta.

21. An image forming system according to claim 12, wherein:

the indications of color which indicate at least four different colors of consumable material are the same colors as the colors of the consumable materials.

22. An image forming system according to claim 12, wherein:

the means for displaying includes a display portion that is configured to emit a colored light.

23. An image forming system, comprising:

a plurality of containers, arranged in a sequential order within the image forming system, the containers including at least four different colors of consumable material used to print an image on a medium;

a cover which covers the plurality of containers;

a printing engine configured to print the image on the medium using the consumable material; and an operation panel, mounted to the image forming system, including a display, the display configured to display information of the consumable material within the containers such that there is a display portion corresponding to each of the containers and an arrangement of the display portions corresponds to said sequential order of the plurality of containers, when viewed from a side of the operation panel, the display portions each having an indication of color of the consumable material in a corresponding one of the plurality of containers such that a sequence of colors of the consumable material of the plurality of containers is the same as a sequence of the display portions corresponding to the containers, wherein the indications of color indicate at least four different colors of consumable material, and the display portions corresponding to each of the containers are adjacent to no more than two others of the plurality of indicators, wherein when the consumable material in one of the plurality of containers becomes an empty state, the corresponding display portion indicates that there is no substance of a particular color for use in the image forming system, and wherein the image forming system is structured such that when the cover is at an open position, the containers within the image forming system and the display portions corresponding to each of the containers are simultaneously viewable.

24. An image forming system according to claim 23, wherein:

the indications of color which indicate at least four different colors of consumable material indicate colors of the consumable material which are black, yellow, cyan, and magenta.

25. An image forming system according to claim 23, wherein:

the indications of color which indicate at least four different colors of consumable material are the same colors as the colors of the consumable materials.

26. An image forming system according to claim 23, wherein:

the display portion corresponding to each of the containers includes a display portion that is configured to emit a colored light.

* * * * *

UNITED STATES PATENT AND TRADEMARK OFFICE

CERTIFICATE OF CORRECTION

PATENT NO. : 7,853,167 B2
APPLICATION NO. : 11/959049
DATED : December 14, 2010
INVENTOR(S) : Tomohiko Sasaki It is certified that error appears in the above-identified patent and that said Letters Patent is hereby corrected as shown below:

On the title page, Item (62), the Related U.S. Application should read:

-- Related U.S. Application Data

(62) Continuation of application No. 11/281,441, filed on Nov. 18, 2005, now Pat. No. 7,389,064.--

On the title page, Item (30), the Foreign Application Priority Data should read:

-- (30) Foreign Application Priority Data

Nov. 19, 2004 (JP) ..... 2004-335295--

Signed and Sealed this
Twenty-second Day of March, 2011

David J. Kappos

David J. Kappos
*Director of the United States Patent and Trademark Office*